US011831116B2

(12) United States Patent
S N et al.

(10) Patent No.: US 11,831,116 B2
(45) Date of Patent: Nov. 28, 2023

(54) SEAM SELF LOCKING CRIMP

(71) Applicants: TE Connectivity India Private Limited, Bangalore (IN); TE Connectivity Germany GmbH, Bensheim (DE)

(72) Inventors: Shashikumar S N, Chickmagalur (IN); Deepak A G, Bangalore (IN); Uwe Bluemmel, Hemsbach (DE)

(73) Assignees: TE Connectivity Germany GmbH, Bensheim (DE); TE Connectivity India Private Limited, Bangalore (IN)

( * ) Notice: Subject to any disclaimer, the term of this patent is extended or adjusted under 35 U.S.C. 154(b) by 135 days.

(21) Appl. No.: 17/136,217

(22) Filed: Dec. 29, 2020

(65) Prior Publication Data

US 2021/0119353 A1 Apr. 22, 2021

Related U.S. Application Data

(63) Continuation of application No. PCT/EP2019/066654, filed on Jun. 24, 2019.

(30) Foreign Application Priority Data

Jun. 29, 2018 (IN) ..... 201841024239

(51) Int. Cl.
*H01R 4/16* (2006.01)
*H01R 4/18* (2006.01)

(52) U.S. Cl.
CPC ..... *H01R 4/184* (2013.01); *H01R 4/16* (2013.01)

(58) Field of Classification Search
CPC .... H01R 13/4223; H01R 4/184; H01R 4/185; H01R 4/16
See application file for complete search history.

(56) References Cited

U.S. PATENT DOCUMENTS 1,672,201 A 6/1928 Champion
3,032,602 A 5/1962 Farnell
4,415,223 A * 11/1983 Asick ..... H01R 9/0518 439/879
4,692,122 A * 9/1987 Montalbano ..... H01R 4/184 29/863
4,932,906 A * 6/1990 Kaley ..... H01R 4/206 29/863

(Continued)

FOREIGN PATENT DOCUMENTS

CN 203232961 U 10/2013
DE 102006045567 A1 4/2008

(Continued)

OTHER PUBLICATIONS

PCT International Preliminary Report on Patentability and the Written Opinion, dated Dec. 29, 2020, 9 pages.

(Continued)

*Primary Examiner* — Truc T Nguyen
(74) *Attorney, Agent, or Firm* — Barley Snyder

(57) ABSTRACT

A crimp includes a crimp barrel having a base, a first side wall extending from the base, and a second side wall extending from the base opposite to the first side wall, a self-locking wing on the first side wall, and a self-locking pocket on the second side wall. The self-locking wing is adapted to lock with the self-locking pocket.

13 Claims, 4 Drawing Sheets

(56) References Cited

U.S. PATENT DOCUMENTS 5,901,439 A 5/1999 Endo et al.
7,980,894 B1 * 7/2011 Hall ..... H01R 24/40 439/585
8,167,666 B2 * 5/2012 Koga ..... H01R 43/048 439/852
8,900,020 B2 * 12/2014 Aoki ..... H01R 4/183 439/885
10,199,780 B2 * 2/2019 Volkmann ..... H01R 4/20
10,594,048 B2 * 3/2020 Bluemmel ..... H01R 4/184
2008/0188144 A1 * 8/2008 Myer ..... H01R 13/113 439/852
2008/0293287 A1 * 11/2008 Zinn ..... H01R 13/113 439/370
2008/0305668 A1 * 12/2008 Wu ..... H01R 13/20 439/272
2009/0035987 A1 * 2/2009 Daly ..... H01R 24/30 439/502
2009/0163072 A1 * 6/2009 Schimmele-Brell ..... H01R 13/625 439/357
2009/0305582 A1 * 12/2009 Hernandez ..... H01R 43/16 29/874
2010/0075528 A1 * 3/2010 Ngo ..... H01R 4/183 439/372
2010/0130074 A1 * 5/2010 Kataoka ..... H01R 13/20 439/816
2010/0136832 A1 * 6/2010 Kawaguchi ..... H01R 13/6593 439/607.03
2010/0210154 A1 * 8/2010 Boemmel ..... H01R 13/432 439/877
2010/0221949 A1 * 9/2010 Okamoto ..... H01R 9/0518 439/585
2010/0267269 A1 * 10/2010 Umehara ..... H01R 13/627 439/345
2010/0311269 A1 * 12/2010 Sattazahn ..... H01R 13/5808 439/471
2011/0034091 A1 * 2/2011 Kobayashi ..... H01R 4/185 439/877
2011/0136397 A1 * 6/2011 Koga ..... H01R 4/185 439/877
2011/0294368 A1 * 12/2011 Nakata ..... H01R 4/184 439/887
2012/0009828 A1 * 1/2012 Yagi ..... H01R 13/44 29/863
2015/0255886 A1 * 9/2015 Schmidt ..... H01R 4/183 439/877
2021/0119354 A1 * 4/2021 Bluemmel ..... H01R 4/184

FOREIGN PATENT DOCUMENTS

EP 1764869 A2 3/2007
GB 2041794 A 9/1980
JP 2010055903 A 3/2010
JP 201460103 A1 4/2014
NL 6610432 A 2/1967

OTHER PUBLICATIONS

PCT Notification, International Search Report and the Written Opinion, dated Aug. 28, 2019, 17 pages.
Abstract of DE 102006045567, dated Apr. 24, 2008, 1 page.
Chinese Office Action and English translation, App No. 201980043288.1, dated Sep. 9, 2021, 16 pages.
Japanese Office Action and English Translation, Application No. 2020572507, dated Mar. 1, 2022, 14 pages.
Office Action from the Intellectual Property Office (Korea) dated Oct. 6, 2022 corresponding to Application No. 10-2020-7037670, 5 pages.

* cited by examiner

SEAM SELF LOCKING CRIMP

CROSS-REFERENCE TO RELATED APPLICATIONS

This application is a continuation of PCT International Application No. PCT/EP2019/066654, filed on Jun. 24, 2019, which claims priority under 35 U.S.C. § 119 to Indian Patent Application No. 201841024239, filed on Jun. 29, 2018.

FIELD OF THE INVENTION

The present disclosure relates to a crimp and, more particularly, to a seam self-locking crimp.

BACKGROUND

In electronics and electrical engineering, there are known a large number of electromechanical connections, which serve to transmit electrical currents, electrical voltages and/or electrical signals with the greatest possible range of currents, voltages, and frequencies and/or data rates. Such connections must temporarily, where applicable after a comparatively long period of time, or permanently ensure correct transmission of mechanical contact, electrical power, electrical signals and/or data under thermally loaded, dirty, damp and/or chemically aggressive conditions. Therefore, a large number of specially constructed electromechanical contacts, in particular crimp contacts are known.

A crimp connection is a solderless connection. A crimp connection is advantageous over normal pinching of the terminal on to the end of a wire. The shape of the crimp and amount of pressure applied must be correct in order to obtain the desired performance and durability of the connection. Improper crimps may generate heat due to poor electrical connections and may result in the rework of the product, increased scrap, and in extreme cases catastrophic failure.

Electrical terminals are often used to terminate the ends of wires. Such electrical terminals typically include an electrical contact and a crimp barrel. In some terminals, the crimp barrel includes an open area that receives an end of the wire therein. The crimp barrel is crimped around the end of the wire to establish an electrical connection between electrical conductors in the wire and the terminal as well as to mechanically hold the electrical terminal on the wire end. When crimped over the wire end, the crimp barrel establishes an electrical and mechanical connection between the conductors of the wire and the electrical contact.

In addition to a permanent electrical connection, a permanent mechanical connection must also be produced between the cable and a conductor crimp region of the crimp contact by a contact. For an electromechanical connection, the crimp contact has a conductor crimp region, and in most cases an insulation crimp region for the cable. Miniaturization and cost savings are forcing manufacturers towards smaller and thinner contacts.

Crimp connections known in the art serve to establish an electrical contact as well as to provide a mechanically resilient connection between a crimping base and at least one electrical conductor, which can consist of one or more individual wires. The crimp barrel usually consists of a metal plate, which is bent to have a U- or V-shaped cross-section, or has rectangular cross-sections with a flat base. The underside of the U- or V-shape is hereinafter referred to as crimp base. The upwardly pointing legs of the U- or V-shape are generally known as crimp flanks.

FIG. 1 shows a typical wire barrel crimp 200 as found in the prior art. Such a crimp suffers from the problem of lack of robustness during mechanical and torsional stresses.

The crimp connection is produced by a crimping die, which consists of an anvil and crimping stamp. For crimping, the crimping base is positioned centrally on the anvil, and the electrical conductor is placed between crimping legs on the crimping barrel. Subsequently, the crimping stamp descends onto the anvil and bends the crimp flanks around the electrical conductor in order to compress it tightly, and to fix it in a force-locking manner with the crimping barrel. In the transition area from the crimp base to the crimp side-walls, the so-called crimping roots, as well as laterally at the crimp side-walls, zones of high bending stresses are formed in the crimp barrel.

The force connection between the crimp barrel and the electrical conductor can be improved by providing additional form-fitting elements, for example, recesses or depressions on the inner side of the crimp barrel facing the conductor for the creation of locking elements, wherein displaced conductor material can penetrate into the recesses during compression.

The pressed zones of a crimping connection have better electrical properties. The less heavily pressed areas have a higher mechanical stability. The crimping barrel and the electrical conductor can be locally reinforced by means of steps or projections in the crimping die.

U.S. Pat. No. 5,901,439 discloses how the compression can be locally increased by feeding an additional punch through an opening in the working surface of the anvil when the crimping die is closed.

Patent Application DE 10 2006 045 567 A1 describes a staggered seam on an F-Crimp formed by a crimp tool with consecutive offset in the roll-in geometry. In this crimp connection, the crimp with a thinner sheet metal presents the problems mentioned below.

If the crimp connection is subjected to mechanical stress, the crimping flanks may spring up along the crimping roots and other zones of high bending stresses. There is the risk that the crimping base opens along the longitudinal seam at the ends of the crimp side-walls. Depending on the type of stress, the ends of the crimp side-walls can also move axially relative to each other. Moreover, a reduction in the crimping forces in the prior art is favored in that the individual wires of the electrical conductor can move relative to each other. When they are displaced in the longitudinal direction, the force of the crimped connection is reduced by the resultant free spaces. The free spaces offer the possibility of external material penetrating into the crimped connection. The crimping forces are then further weakened by corrosion of the electrical conductor and the crimping barrel caused by the external agents.

In the event of a loss of crimping force, the desired mechanical stability of the crimping connection can no longer be maintained. It was found with conventional crimps that in case of movements on the connected line or the electrical conductor, a movement of the individual wires of the electrical conductor at the other end of the crimp connection can be observed. This indicates that both the individual wires of the electrical conductor, as well as the electrical conductor and the crimp barrel, are no longer fixed in a sufficiently secure manner. In the individual case, therefore, increased electrical transition resistances between the crimp barrel and the electrical conductor can occur.

To achieve mechanical and electrical robustness of a crimp, in particular an F-Crimp, the crimp barrel must have a sufficient stock thickness of the sheet metal (related to the wire size). Especially for large wires, this minimum barrel stock thickness creates disadvantages such as less suitability to be cut or bent in stamping process for manufacturing an electrical terminal from sheet metal, high force required for the crimp process, and high material cost. In order to address the above problems, crimps in the prior art uses a thin stock. However, it was found that with that when using too thin stock the crimp starts to fail at the seam of the roll-in for mechanical and electrical performance. There is a need for providing a terminal device that allows safely, electrically connecting a large number of wires, and the terminal device being robust and cost effective at the same time.

SUMMARY

A crimp includes a crimp barrel having a base, a first side wall extending from the base, and a second side wall extending from the base opposite to the first side wall, a self-locking wing on the first side wall, and a self-locking pocket on the second side wall. The self-locking wing is adapted to lock with the self-locking pocket.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
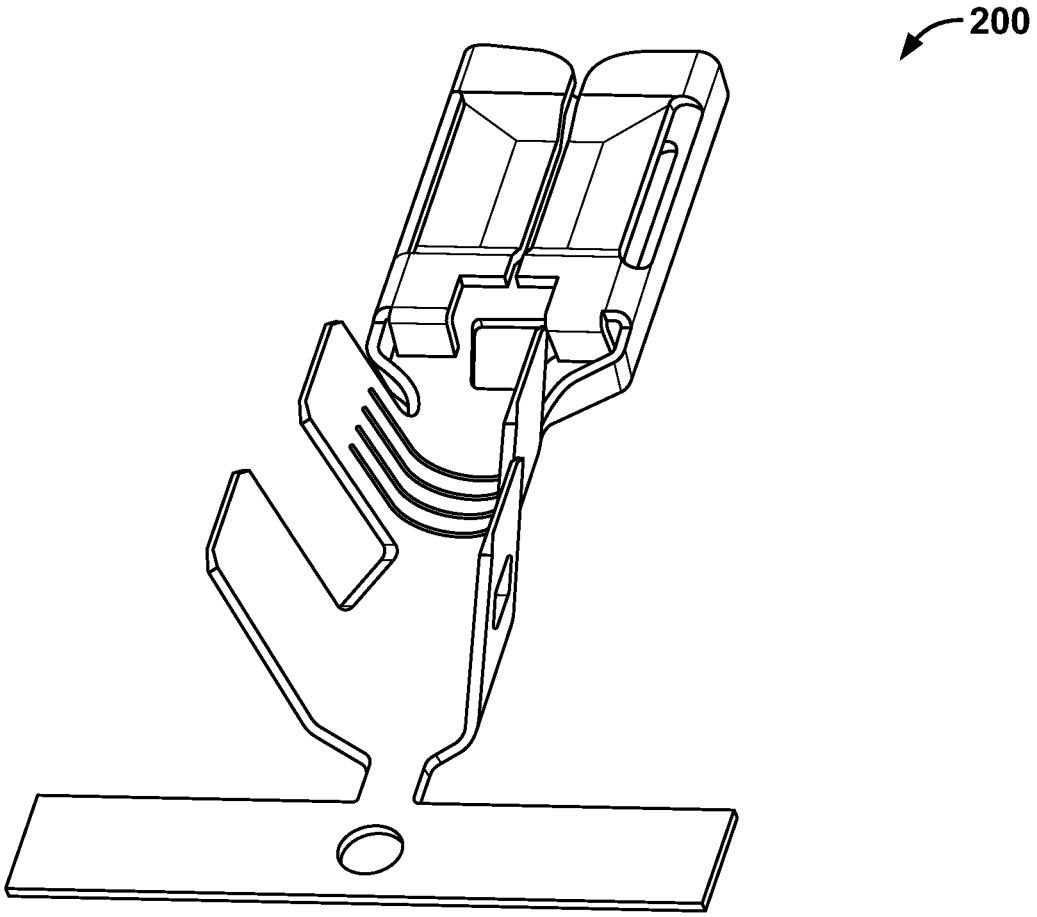
Fig. 1 PRIOR ART
FIG. 1 is a perspective view of a crimp barrel according to the prior art.

The invention is explained in greater detail below with reference to embodiments and the appended drawings. Elements or components which have an identical, univocal or similar construction and/or function are referred to in various Figures of the drawings with the same reference numerals. Benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

Specific embodiments of the present disclosure are described below. Note, however, that an excessively detailed description may be omitted. For example, a detailed description of an already well-known matter, and a repeated description of substantially identical components may be omitted. This is intended to avoid unnecessary redundancies of the following description and facilitate understanding of persons skilled in the art. It should be noted that the accompanying drawings and the following description are provided so that persons skilled in the art can fully understand the present disclosure, and that the accompanying drawings and the following description are not intended to limit the subject matter recited in the claims.

Figure 2:
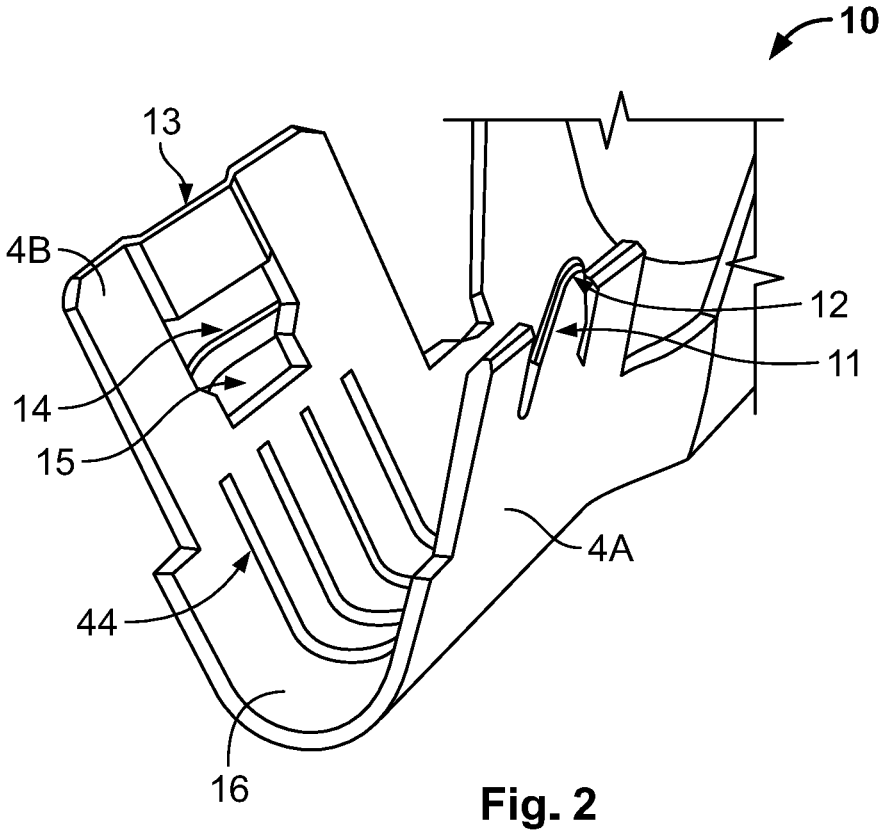
FIG. 2 is a perspective view of a seam self-locking crimp according to an embodiment.

A seam self-locking crimp 10 according to an embodiment is shown in FIG. 2. The crimp 10 has a first side wall 4A with a self-locking wing 11 and an entry chamfer 12, and a second side wall 4B with a self-locking pocket 14, a front entry guide 13, and a rear entry guide 15. The first side wall 4A and the second side wall 4B are opposing side walls extending from a base of the crimp 10.

During crimping of the crimp 10, the self-locking wing 11 gets interlocked with the self-locking pocket 14, which in turn gives more mechanical robustness and electrical robustness against mechanical and torsional stresses for a crimp 10 with a thinner stock thickness. Due to the compression and axial elongation during forming of the seam self-locking crimp 10, the edges of the self-locking wing 11 and self-locking pocket 14 get squeezed against each other, which creates an additional clinch connection of the seam, thus providing additional robustness.

Figure 3B:
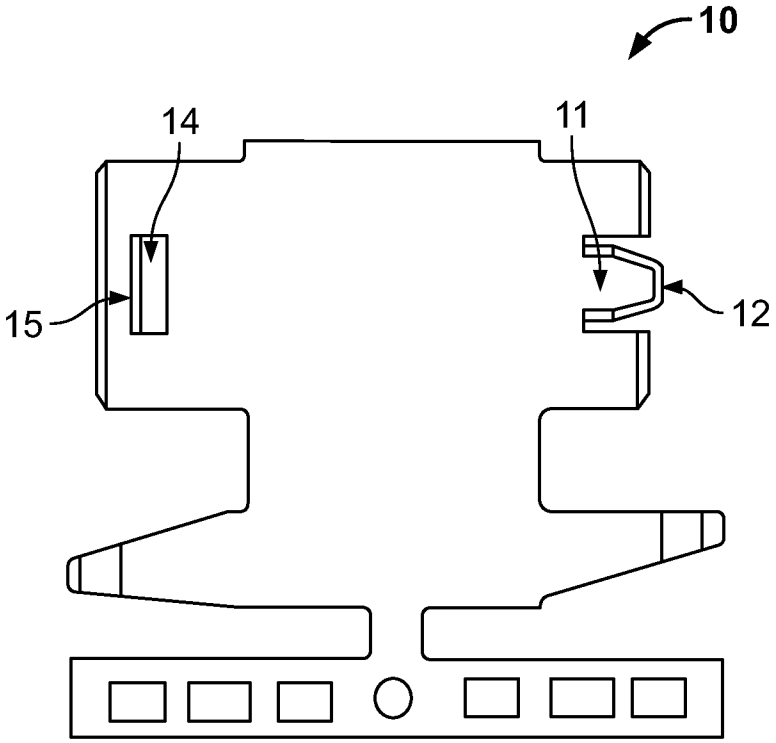
FIG. 3B is a bottom plan view of the seam self-locking crimp of FIG. 2.
Figure 3A:
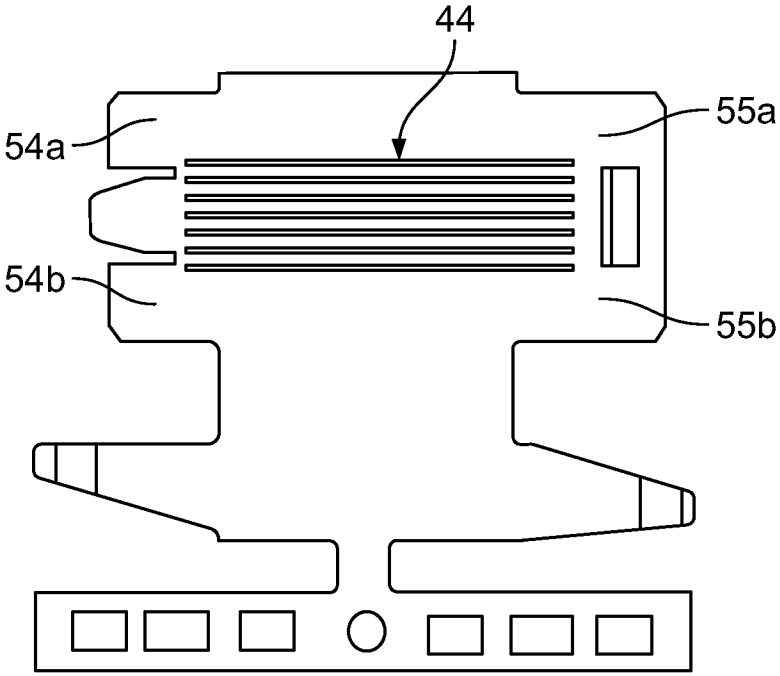
FIG. 3A is a top plan view of the seam self-locking crimp of FIG. 2.

FIG. 3A is a flat perspective top view of the seam self-locking crimp 10 according the present disclosure. Various dimensions of the self-locking wing 11 and the self-locking pocket 14 can be suitably adapted to the particular use case. FIG. 3B shows the respective bottom view before the crimp 10 is bent. In an embodiment, as shown in FIG. 3A, an interior surface of the crimp 10 may include one or more serrations 44 for penetrating an oxide and/or other surface material (such as, but not limited to, residual wire extrusion enhancement materials, and/or the like) layer that has built up on an electrical conductor. The interior surfaces may each be referred to herein as a "metallic surface" of the crimp 10.

Figure 4:
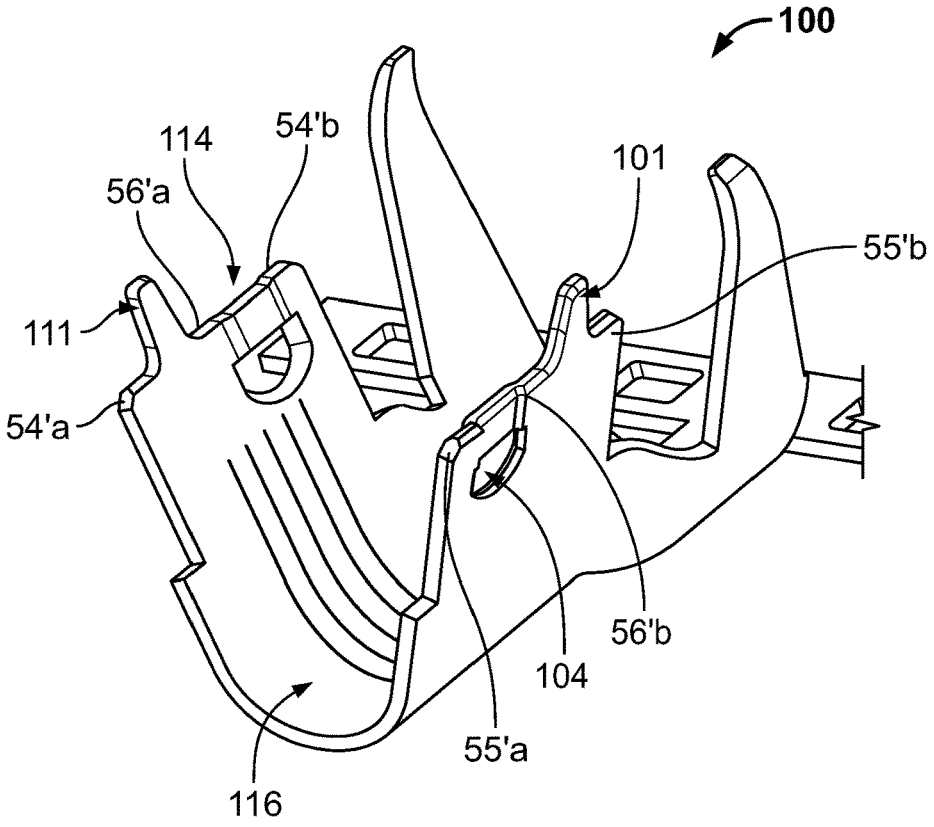
FIG. 4 is a perspective view of a seam self-locking crimp according to another embodiment.

A seam self-locking crimp 100 according to another embodiment of a crimp connection is shown in FIG. 4. In this embodiment, a first side wall has a self-locking wing 101 and a self-locking pocket 104, and an opposite side wall has a self-locking wing 111 and a self-locking pocket 114. Further, depending on the use case, different combinations of the self-locking wings 101, 111 and the self-locking pocket 104, 114 could be realized in the present embodiment. Such additional self-locking wings 101, 111 and self-locking pockets 104, 114 provide extra robustness to enhance the resilience of the seam self-locking crimp 100 against stress.

In order to contact an electrically conductive wire, the crimp 100 is, for example, attached to a non-insulated wire. The electrical insulation layer may be removed from at least a portion of ends of the electrical conductors for exposing the conductor ends. In some alternative embodiments, the electrical contact is another crimp barrel 16 that is configured to be crimped around the end of another electrical wire, to mechanically and electrically connect the other electrical wire to the terminal. Accordingly, in some alternative embodiments, the terminal is configured to electrically connect the electrical wire to another electrical wire. In other words, the terminal may be used to splice the electrical wire to another wire in some alternative embodiments.

The crimps 10, 100 of the above embodiments are used for realizing the electrical and mechanical connections using a crimping device or crimper. The crimping device crimps a crimp 10, 100 to a wire. In an embodiment, the electrical wire has electrical conductors that are received in a crimp barrel 16, 116, shown in FIGS. 2 and 4. For example, an end segment of the wire has exposed conductors that are loaded into the crimp barrel 16, 116. During a crimping operation, the barrel 16, 116 is crimped around the conductors forming a mechanical and electrical connection between the crimp 10, 100 and the electrical wire. The seam self-locking crimps 10, 100 may also be referred to as crimp segments 10, 100 herein.

Figure 5:
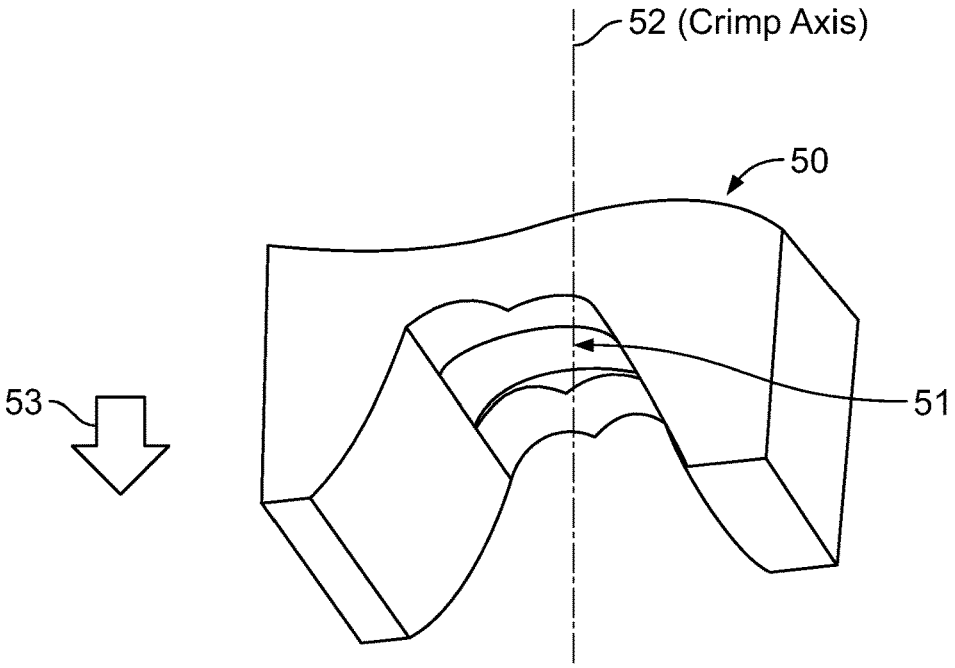
FIG. 5 is a perspective view of a crimping device used in a crimping tool according to an embodiment.

FIG. 5 is schematic view of a crimping device 50 also known as a "crimper" used in a crimping tool according a method of the present disclosure. When the crimping is started, the self-locking wing 11, 101, 111 will enter inside the self-locking pocket 14, 104, 114 and get crimped with wire strands. A groove 51 in the crimper 50 allows the easy flow of the self-locking wing 11, 101, 111 for creating a seam self-locking.

The crimping operation entails forming the crimp segment 10, 100 to mechanically hold the conductors, and to provide an engagement between the conductors and the crimp segment 10, 100. Forming of the terminal may include bending arms or tabs around the wire conductors as in an open terminal (e.g., "F" type crimp), or compressing a closed barrel around the wire conductors as in a closed terminal (e.g., "O" type crimp). As the terminal is formed around the wires during the crimping action, the metal of the terminal and/or of the conductors within the terminal may be extruded. It is desirable to provide a secure mechanical connection, and a good quality electrical connection between the terminal and the electrical wire. Using the embodiments of crimp tooling as disclosed herein creates a formed feature on the terminal that is formed during the crimping operation due to the extrusion of the metal(s). With this tooling, the formed feature can be formed on various types of terminals with varying terminal shapes and designs.

The crimping device 50 is provided with a crimping tooling member or groove 51 with a profile for crimping the crimp 10, 100. During crimping, the profile aligns operationally with a front portion 54*b*, 55*b* and a rear portion 54*a*, 55*a* the walls of the crimp barrel 16 as shown in FIGS. 2 to 3B. In an alternative embodiment, the crimping tooling member 51 is such that, during crimping, the crimping profile aligns operationally with a front portion 54'*b*, 55'*b*, a middle portion 56'*a*, 56'*b* and a rear portion 54'*a* 55'*a* of the walls of the crimp barrel 116 having a self-locking wing 101, 111 and a self-locking pocket 104, 114 on the same wall as shown in the embodiment of FIG. 4.

In an embodiment, the length of the side walls 4A, 4B is such that when the side walls 4A, 4B are engaged to form a staggered seam, the ends of the side walls 4A, 4B do not hit an inner surface of the crimp barrel 16, 116.

The crimping device 50, may include an anvil and the crimp tooling member 51. The anvil has a top surface that receives the crimp segment 10, 100 thereon. The electrical conductors of the wire are received in the crimp barrel 16, 116 on the anvil. The crimp tooling member 51 includes a forming profile that is selectively shaped to form or crimp the barrel 16, 116 around the conductors when the forming profile engages the crimp segment 10, 100. The forming profile defines part of a crimp zone in which the crimp segment 10, 100 and wire are received during the crimping operation. The top surface of the anvil also defines a part of the crimp zone, as the terminal is crimped to the wire between the crimp tooling member 51 and the anvil.

The crimp tooling member 51 is movable towards and away from the anvil along a crimp stroke in a direction 53 as shown in FIG. 5. The crimp stroke has an upward component away from the anvil, and a downward component towards the anvil. The crimp tooling member 51 moves bi-directionally towards and away from the anvil, along a crimp axis 52. The crimp tooling member 51 forms the terminal around the electrical conductors during the downward component of the crimp stroke as the crimp tooling member 51 moves towards the anvil. Although not shown, the crimp tooling member 51 may be coupled to a mechanical actuator that propels the movement of the crimp tooling member 51 along the crimp stroke. For example, the crimp tooling member 51 may be coupled to a movable ram of an applicator, or lead-maker machine. In addition, the applicator or the lead-maker machine may also include or be coupled to the anvil and the base support of the crimping device.

During a crimping operation, the crimp segment 10, 100 is loaded onto the top surface of the anvil. The wire is moved in a loading direction towards the crimp zone such that the electrical conductors are received in the crimp barrel 16 between the two side-walls 4A, 4B of the crimp barrel 16, 116. As the crimp tooling member 51 moves toward the anvil, the forming profile descends over the crimp barrel 16, 116 and engages the side-walls 4A, 4B to bend or form the walls 4A, 4B around the electrical conductors. More specifically, side tabs and the top-forming surface of the forming profile gradually bend the side-walls 4A, 4B over a top of the electrical conductors as the crimp tooling member 51 moves downward.

The self-locking wing 11, 101, 111 is configured to engage with the self-locking pocket 14, 104, 114 of the crimp 10, 100. At a bottom dead position of the crimp tooling member 51, which is the lowest position (or most proximate position to the base support) of the crimp tooling member 51 during the crimp stroke, part of the forming profile may extend beyond the top surface of the anvil. The crimp segment 10 is compressed between the forming profile and the anvil, which causes the side-walls of the crimp barrel 16, 116 to mechanically engage and electrically connect to the electrical conductors of the wire. High compressive forces cause metal-to-metal bonds between the side-walls 4A, 4B and the conductors. One or more embodiments described herein is directed to the forming profile such that, during the seam self-locking operation as described herein, the forming profile is formed when the side-walls 4A, 4B of the crimp barrel 16, 116 engage with each other.

Further the mechanics and the behavior of the crimp connection under external forces will be described.

There are two mechanisms for establishing and maintaining permanent contact in a crimp connection, namely cold welding and the generation of an appropriate residual force distribution. Both mechanisms contribute for creating a permanent connection and are independent of each other. During crimping, two metal surfaces are brought under an applied force to sliding or wiping actions, thus welding the metals in a cold version also known as cold welding. Under an appropriate residual force distribution the contact interface will experience a positive force. During crimping, residual forces are developed between the conductor and the crimp barrel 16, 116 as the crimp tooling is removed which is an indicative of different elastic recovery.

When the electrical conductor tends to the spring back more than the crimp barrel 16, 116, the barrel 16, 116 exerts a compressive force on the conductor which maintains the integrity of the contact interface. The electrical and the mechanical performance of a crimped connection results from a controlled deformation of conductors and crimp barrel 16, 116 which produce micro cold welded junctions between the conductors and between conductors and the crimp barrel 16, 116. These junctions are maintained by an appropriate residual stress distribution within the crimped connection which leads to residual forces which in turn maintain the stability of the junctions.

During the application of an external force (for example tensile force) on the crimp connection, the interlocking between the crimps flanks could be misaligned, thus resulting in a poor crimp connection. Hence, crimp connections with the self-locking wing 11, 101, 111 and the self-locking pocket 14, 104, 114 are provided in embodiments of the seam self-locking crimp connection of the present disclosure. Such tapered embossed areas could be provided both inside or outside of the crimp flanks thereby ensuring that interlocking is maintained even when the tensile force applied at an angle not equal to the normal vector in the lateral direction of the outer surface of the crimp flank.

While the present disclosure has been particularly shown and described with reference to exemplary embodiments thereof, it will be understood by those skilled in the art that various changes in form and details may be made therein without departing from the disclosure as defined by the appended claims. The exemplary embodiments should be considered in descriptive sense only and not for purposes of limitation. Therefore, the scope of the present disclosure is defined not by the above description of the invention but by the appended claims, and all differences within the scope will be construed as being included in the present invention.

What is claimed is:

1. A crimp, comprising:

a crimp barrel having a base, a first side wall extending from the base, and a second side wall extending from the base opposite to the first side wall;

a self-locking wing on the first side wall; and a self-locking pocket on the second side wall, the self-locking pocket including a front entry guide and a rear entry guide, the self-locking wing is adapted to lock with the self-locking pocket.

2. The crimp of claim 1, wherein the self-locking wing has an entry chamfer.

3. The crimp of claim 1, wherein the first side wall has a second self-locking pocket and the second side wall has a second self-locking wing.

4. The crimp of claim 3, wherein the second self-locking wing is adapted to lock with the second self-locking pocket.

5. The crimp of claim 1, wherein the self-locking wing and the self-locking pocket extend up to the base.

6. The crimp of claim 1, wherein the crimp barrel is an F-crimp wire barrel.

7. A method for producing a crimp, comprising:

bending a base of a crimp barrel around a wire, the crimp barrel has a first side wall extending from the base and a second side wall extending from the base opposite to the first side wall, the first side wall has a self-locking wing and the second side wall has a self-locking pocket, the self-locking pocket including a front entry guide and a rear entry guide; and locking the self-locking wing with the self-locking pocket.

8. The method of claim 7, wherein the self-locking wing has an entry chamfer.

9. The method of claim 7, wherein the first side wall has a second self-locking pocket and the second side wall has a second self-locking wing.

10. The method of claim 9, further comprising locking the second self-locking wing with the second self-locking pocket.

11. The method of claim 7, wherein the crimp barrel is an F-crimp wire barrel.

12. The crimp of claim 1, further comprising a plurality of serrations defined on an interior surface of the base.

13. A crimp, comprising:

a crimp barrel having a base, a first side wall extending from the base, and a second side wall extending from the base opposite to the first side wall;

a first self-locking wing on the first side wall, the first self-locking wing having an entry chamber; and a first self-locking pocket on the second side wall, the first self-locking wing is adapted to lock with the first self-locking pocket.

* * * * *